United States Patent [19]

Stalberger, Jr.

[11] 4,151,994

[45] May 1, 1979

[54] GAME FOOTBAG

[76] Inventor: Robert J. Stalberger, Jr., 18751 Conifer, Oregon City, Oreg. 97045

[21] Appl. No.: 780,449

[22] Filed: Mar. 23, 1977

[51] Int. Cl.[2] ..... A63B 37/02

[52] U.S. Cl. ..... 273/58 A; 273/58 F; 273/DIG. 4; 273/DIG. 8; 273/106 R

[58] Field of Search ..... 273/58 F, 58 H, 58 A, 273/60 A, 65 EC, 106 R

[56] References Cited

U.S. PATENT DOCUMENTS

| | | | |
|---|---|---|---|
| 1,960,803 | 5/1934 | Baumer | 273/60 A X |
| 3,091,460 | 5/1963 | Maldonado | 273/106 R X |
| 3,366,993 | 2/1968 | Lemelson | 273/58 H X |
| 3,450,407 | 6/1969 | Russo | 273/65 EC |
| 3,734,498 | 5/1973 | Seiersen | 273/58 F X |
| 3,924,856 | 12/1975 | Dekan | 273/106 R |
| 3,937,470 | 2/1976 | Stalberger et al. | 273/106 R |

*Primary Examiner*—George J. Marlo

*Attorney, Agent, or Firm*—Kolisch, Hartwell, Dickinson & Stuart

[57] ABSTRACT

A game footbag designed to be kicked repeatedly into the air discloses a durable, flexible cover having a generally spherical shape when fully expanded and partially filled with material having substantially fluid characteristics. The cover consists of two dogbone-shaped pieces of flexible material attached together at their peripheries so as to form a collapsible ball. The fluid material includes a large plurality of small polythylene particles having low resilience. The interaction of the cover with the fluid-like material results in a footbag having a slow-action and uniform response to kicking.

5 Claims, 8 Drawing Figures

GAME FOOTBAG

BACKGROUND OF THE INVENTION

1. Field of the Invention

The present invention relates to a durable, slow-action footbag for use in a game the objective of which is to keep the footbag airborne for as long as possible using one's knees and feet.

2. Background of the Prior Art

People have always been enchanted with the concept of intercepting an object in flight and batting such object back into the air so as to keep such object from reaching the ground. This enchantment has resulted n a number of games, such as volleyball, that test a person's skill in keeping a particular object from reaching the ground. Such games have required, and, as a result, developed, superior eye-to-hand coordination.

Numerous games, exercises and devices also have appeared for developing one's eye-to-foot coordination. In such games and exercises the object is intercepted by the foot and/or knee and kicked repeatedly into the air. Such games and exercises have been found to be extremely helpful in developing not only eye-to-foot coordination, but also the balance and quickness necessary for performing a variety of sports such as baseball, football, basketball, soccer, karate and tennis. These games and exercises have been found to be especially pleasurable and beneficial when the person performs a wide variety of kicks and is able to kick the object with all parts of the feet and knees.

Because the foot and knee generally are not as easily manipulated as the hand, objects suitable for exercises and games wherein the purpose is to keep the object in the air for as long a period of time as possible using only the feet and knees must be slow-acting; i.e., reaction of the object to the force of a kick must be relatively small as compared to the reaction of fast-acting objects such as tennis balls and volley balls. Furthermore, the reaction of the object must be consistent no matter how irregular the surface of the foot or knee contacting the object. In this way, the object may be kicked with the instep, the heel or the toe of the foot and still get a consistent and reliable response. If this were not true, the user would be compelled to kick the object only with the flatest parts of the foot, thus limiting the variety of kicks and negating much of the purpose and pleasure to be derived from the exercises and games. This latter desirable feature is accomplished in part if the portion of the object contacting the foot or knee quickly conforms to the shape of the part of the foot or knee contacted.

Several devices are taught by the prior art which, although slow-acting, do not permit a wide variety of kicks.

SUMMARY OF THE INVENTION

The object of the present invention is to provide a device, referred to hereinafter as a "footbag," that can be kicked continuously into the air using a wide variety of kicks, including kicks from the back, from the front and to the side, using any part of the knees or feet. Furthermore, the reaction of the footbag to any desired kick is consistent and reliable thus increasing the enjoyment and usefulness of the footbag.

The footbag of the present invention combines a cover that, if fully expanded, is nearly spherical in shape, with a filler material having generally fluid characteristics. The cover is made of a lightweight, flexible material that can withstand continuous kicking over a long period of time. The cover consists of two generally, dogbone-shaped pieces attached together about their peripheries. This results in a seam that has no straight lines. As a result, the reaction of the footbag is the same no matter how much the seam is engaged by the foot or knee.

DETAILED DESCRIPTION OF THE PREFERRED EMBODIMENT

Figure 1:
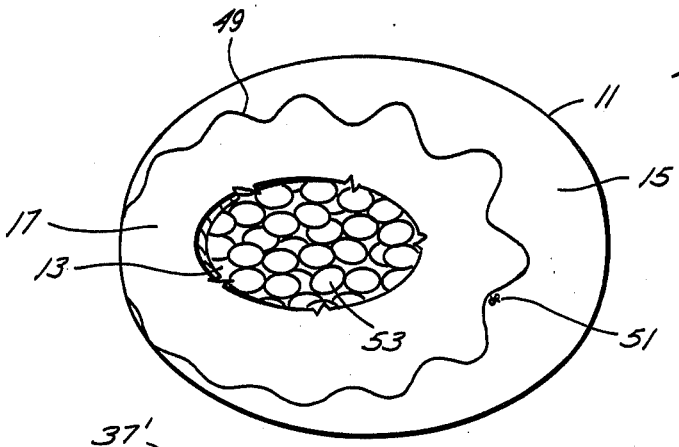
FIG. 1 is a partially sectional perspective view of the preferred embodiment of the invention.

Referring to FIG. 1, the preferred embodiment of the present invention includes a cover 11 partially filled with filler material 13.

(a) Cover

Figure 2:
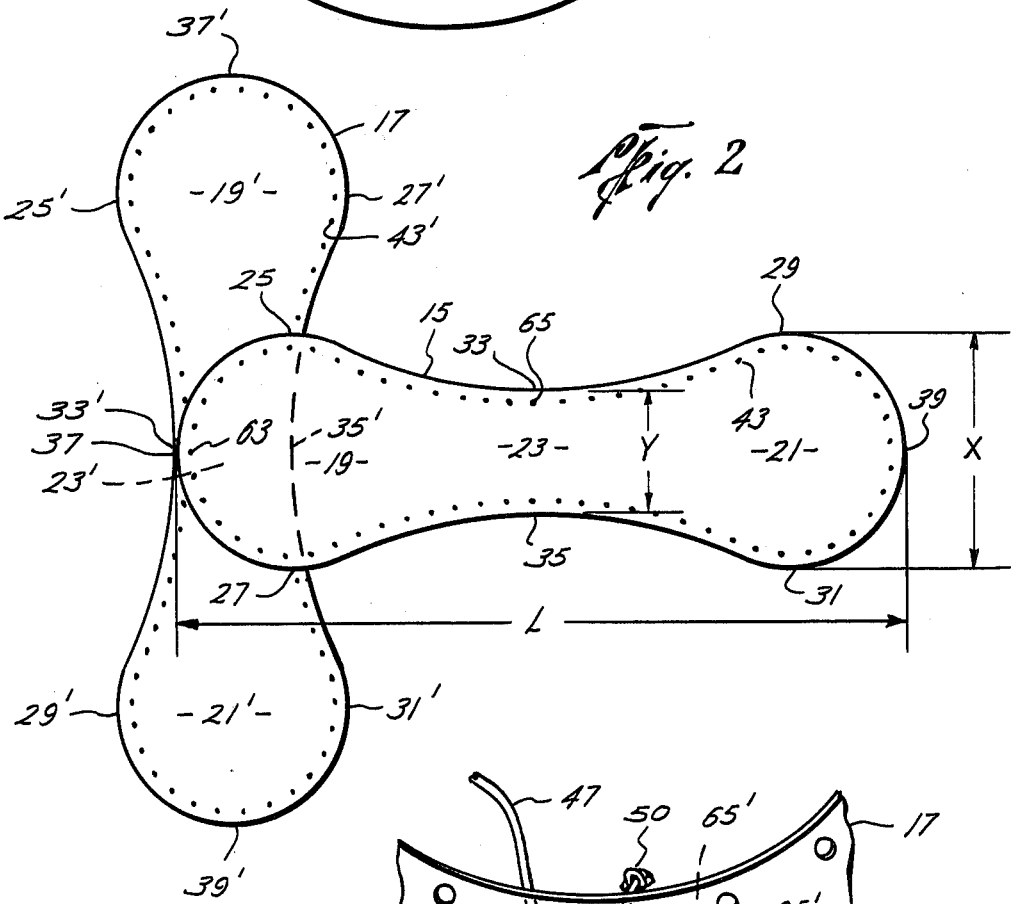
FIG. 2 is a plane view of the pieces of the cover of the preferred embodiment of the invention immediately prior to assembly.

Referring to FIGS. 1 and 2, cover 11 of the preferred embodiment of the invention includes segments 15, 17. Segments 15, 17 should be made of a rugged, flexible material that can withstand continuous kicking over a long period of time without breaking or tearing. Furthermore, because the segments of the preferred embodiment are stitched together as described infra, the material should be capable of retaining a stitch without tearing. Varieties of lightweight leather such as split-leather, buckskin, horsehide and deer-tanned cowhide meet these criteria. Deer-tanned cowhide is preferred. Woven materials such as cloth lack the necessary durability and should not be used. If a leather-like material is used, the smooth side must be on the outside of the cover in order to prevent the cover from peeling.

As shown in FIG. 2, segments 15, 17 are identical and, until attached together to form cover 11, have a flat, generally dogbone-shaped configuration. The overall configuration of segments 15, 17 includes no straight edges. Because segments 15, 17 are identical, a detailed description of segment 15 will serve to describe segment 17. For purposes of subsequent description, the reference numbers for segment 17 are the same as those set forth for segment 15. A prime (') is added to the segment 17 reference numbers in order to avoid confusion.

Segment 15 includes major width portions 19, 21 joined together by minor width portion 23. Preferably, width X of major width portions 19, 21, i.e., the distance between points 25, 27 at the centers of either side of major width portion 19 and between points 29, 31 at the centers of either side of major width portion 21, is 2 inches; width Y of minor width portion 23, i.e., the distance between points 33, 35 at the centers of either side of minor width portion 23, is 1⅛ inches; and length L, i.e., the distance between points 37, 39 at the extreme ends of segment 15 is 6 inches. These dimensions are preferred because when the cover is made of the preferred material and the preferred filler material described infra are used, the resulting embodiment has a size, approximately 2 inches in diameter, and weight that provides an optimum reaction when kicked by the user. These dimensions may vary in minor degrees and still obtain the benefits of the present invention. The resultant cover, however, should not be smaller than 1½ inches in diameter or more than 3 inches in diameter. If the diameter is less than 1½ inches, the footbag will have too small a surface area to be kicked. If the diameter is greater than 3 inches, the footbag will be too heavy and too floppy.

The periphery of segment 15 is perforated with a plurality of evenly-spaced seam holes 43. A segment having the preferred dimensions preferably has 72 seam holes 43 each spaced 3/16 inch from the edge of segment 15. Preferably, segment 15 has seam hole 63 adjacent point 37 and seam hole 65 adjacent point 33.

When incorporated into cover 11, the edge of segment 15 is attached to the edge of segment 17 such that each seam hole 43 of segment 15 is centered over a seam hole 43' of segment 17. The peripheries of segments 15, 17 are turned inwardly of cover 11 and are secured together by thread 47 forming inside seam 49. When segments 15, 17 are secured together as described, cover 11 assumes the approximate shape of a collapsible sphere.

Figure 3:
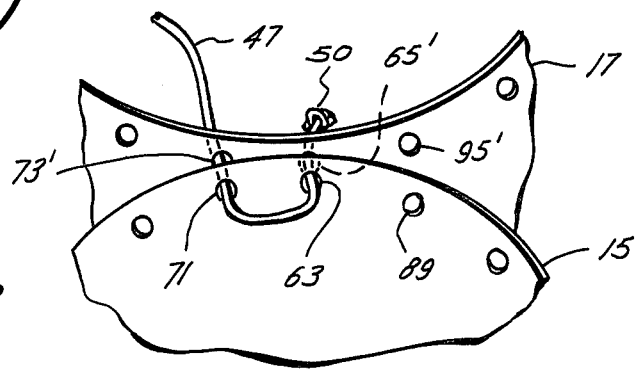
FIG. 3 is an enlarged, partial perspective view of the pieces of the cover of the preferred embodiment of the invention during the initial steps of assembly.

Thread 47 of seam 49 should be strong, flexible and ravel resistant. Waxed, nylon cord is preferred. Thread 47 should be knotted in as few places as possible, preferably only at either end. The knots should be strong and should not be so large as to adversely affect the reaction of the embodiment. As shown in FIG. 3, thread 47 has knot 50 at one end and a knot at the other end.

The embodiment of cover 11 as described is preferred because it incorporates the desired features of a footbag in optimum fashion. It is lightweight and can be kicked reasonable distances, such as from the front to the rear of the user, without excessively tiring the user. Furthermore, such a cover is rugged and can withstand repeated kicking without excessive wear.

Additionally, the cover described is flexible and can conform quickly to the shape of the surface of the knee or foot contacting the footbag and this reaction is consistent no matter what part of the cover is contacted. This is due to several important features of the preferred embodiment. First, the shape of segments 15, 17 results in a seam configuration that is uniquely flexible. There are no straight edges. The seam flows in that it constantly changes directions. As a result, cover 11 has a normal shape, but may assume an infinite variety of shapes with equal ease. The shape of segments 15, 17 further results in a cover that is very nearly spherical shape when fully expanded which contributes to the uniformity of reaction. Furthermore, the resultant cover has no points where the seam is concentrated and no large areas where there are no seams. Thus, the amount of seam contacted on each kick is approximately the same. The shape also results in only a single seam. Thus, the seam need have only a single knot.

Second, the use of a sewn seam rather than a chemical bonding agent, such as a cement, for attaching segments 15, 17 together results in greater flexibility since chemical bonds tend to stiffen when dry.

(b) Filler

Filler material 13 includes a large plurality of pellets 53. The size and shape of pellets 53 as well as the material from which pellets 53 are made should be such that filler material 13 has a low resilience and has a generally fluid characteristic, defined herein as the ability of the components making up the filler to move and change their position relative to one another easily irregardless of the angle at which the foot or knee engages the footbag. Furthermore, the weight of pellets 53 and the number of pellets 53 used should be such that filler material 13 gives the footbag sufficient mass to be propelled through the air, but should not be so heavy as to excessively tire the user or to make kicking the footbag from the front to the rear of the user an unnecessarily strenuous task.

Figure 4:
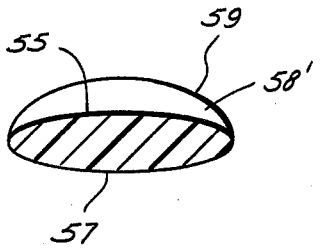
FIG. 4 is an enlarged, sectional perspective view of a disc of an alternative filler material.

These criteria are met especially well if spherical pellets each having a diameter of approximately ⅛ inch and made of polyurethane are used and the cover 11 is filled two-thirds full of such pellets. This size, shape and material for pellets 53 result in a filler material which works in an optimum manner when used in conjunction with preferred cover 11. The size and shape can be modified in some degrees, however, and still obtain the benefits of the invention. For example, the spherical shape is preferred because such a shape yields a very nearly fluid characteristic. A discoidal shape such as that shown for pellet 58' in FIG. 4 may be used since it too will result in a filler material having a very nearly fluid characteristic. Pellet 58' has convex surfaces 55, 57 and a rounded annular periphery 59. If a discoidal shape is used, however, the ridges should be subdued because abrupt ridges tend to cause the pellets to grab one another or to assume a certain orientation with one another thus precluding a fluid characteristic. For example, if flat discs having an annular periphery are used, the discs will tend to orient themselves so that the flat surfaces abut one another.

Furthermore, the pellets 53 may have a larger or smaller diameter. If smaller pellets are used, however, they may tend to become packed causing the filler material to become a single solid mass that will inhibit the cover in conforming to the shape of the surface contacting the footbag. Also, if during prolonged use, seam 49 should loosen slightly, smaller pellets will tend to escape cover 11 more readily thus shortening the useful life of the footbag.

Polyethylene resin is the preferred material for pellets 53 because it not only has low resilience and an ideal weight, but also provides a fairly frictionless surface further contributing toward the fluid characteristic of filler material 13.

The quantity of pellets 53 may be increased or decreased so that cover 11 is more than or less than two-thirds full so long as sufficient space is left to permit filler material 31 to move around within cover 11 so that the footbag will readily conform to the shape of the surface contacting the footbag.

Figure 5:
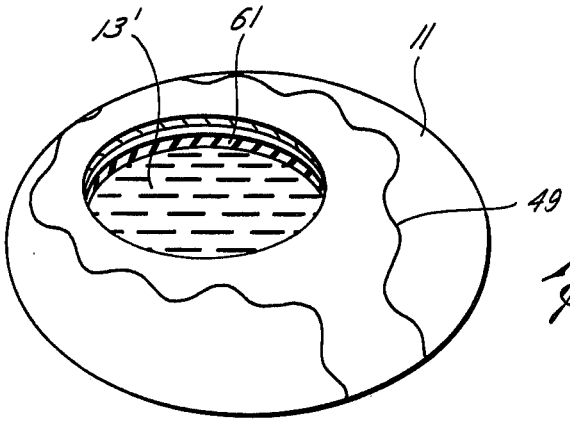
FIG. 5 is a partly sectional perspective view of an alternative embodiment of the invention.

As shown in FIG. 5, a low-viscosity liquid 13' such as water may be used as a filler material. A liquid, of course, has a true fluid characteristic and is desirable from that standpoint. If a leather-like material is used for cover 11, however, cover 11 will be saturated by the liquid thus adversely affecting its response characteristic and limiting its useful life. Furthermore, a liquid will readily leak from cover 11, especialy if a sewn seam 49 is used for attaching segments 15, 17 together.

Referring further to FIG. 5, these disadvantages of a liquid filler may be eliminated by including a flexible bladder 61 having the same general size and expanded shape as cover 11 within cover 11. The material from which bladder 61 is made should be durable, lightweight and flexible. Rubber is an example of such a material. Use of bladder 61, however, will adversely affect the response of the footbag to kicking since it will add weight to the footbag and decrease the overall flexibility of the cover.

(c) Assembly

Assembly of the footbag of the preferred embodiment is shown in FIGS. 2 and 3. Preferably, segments 15, 17 are cut from a sheet of deer-tanned cowhide using a steel rule die. Because segments 15, 17 are identical, a number of segments may be cut at one time by folding the sheet over itself several times or using several sheets of cowhide.

Segments 15, 17 are then attached together to form a cover 11 as follows. Segment 17 is laid flat with its smooth surface facing upwardly. Segment 15 is positioned perpendicular to segment 17 with its smooth surface facing downwardly and with major width portion 19 of segment 15 positioned over minor width portion 23' of segment 17 such that seam hole 63 of segment 15 is positioned over seam hole 65' of segment 17.

Referring particularly to FIG. 3, a length of waxed nylon thread 47 having knot 50 at one end is pulled through a seam hole 65' from the rough side of segment 17, through seam hole 63 and out at the rough side of segment 15 until knot 50 prohibits pulling thread 47 any further. Preferably, a needle is used for facilitating pulling thread 47 through the seam holes.

Seam hole 71 of segment 15 to the immediate left of seam hole 63 is then centered over seam hole 73' of segment 17 to the immediate left of seam hole 65'. Thread 47 is then stitched through seam hole 71 from the rough side of segment 15, through seam hole 73' and out at the rough side of segment 17.

This procedure of alignment and stitching is continued by aligning the successive seam holes of one segment over the corresponding seam holes of the other segment and stitching the thread through the aligned seam holes. As this is done, the segments are distorted from their otherwise flat configuration causing segments 15, 17 together to form a general ball shape with the rough surface to the outside.

Figure 6:
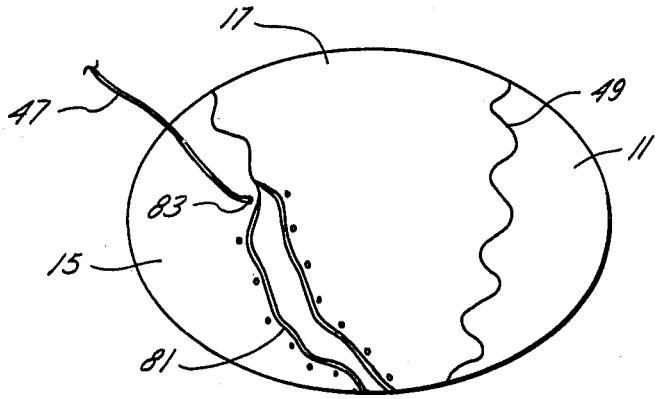
FIGS. 6 and 7 are perspective views of the preferred embodiment of the invention during the final steps of assembly.

This initial stitching procedure is stopped before the entirety of the peripheries are sewn together in order to leave a gap in the seam. The gap should be of sufficient size to permit the cover to be tucked inside out through the gap but not much larger than necessary to permit such tucking. In the preferred embodiment, stopping the initial stitiching procedure with eight to ten seam holes left unstitched in each segment will result in a gap of the desired size. Preferably, the initial stitching procedure is stopped when thread 47 has been stitched through only one of two aligned seam holes such that the free end of the thread extends from a seam hole at the smooth side of a segment. The seam hole through which thread 47 is last stitched may be in either of the segments. For present purposes, it is assumed that such seam hole is in segment 15. The cover is tucked inside out through the gap resulting in a cover having a general ball shape with a smooth surface as shown in FIG. 6. The seam sewn during the initial stitching procedure will become inside seam 49. At this stage of assembly, cover 11 has a gap 81 where seam 49 was left unstitched. The free end of thread 47 extends from the smooth side of seam hole 83.

Filler material 13 is then inserted through the gap 81. A funnel can be used to facilitate this procedure. Filling should be continued until the cover is approximately two-thirds full. If the cover is made of a material that will stretch during initial use, filling should be continued until the cover is somewhere between two-thirds and completely full.

Figure 7:
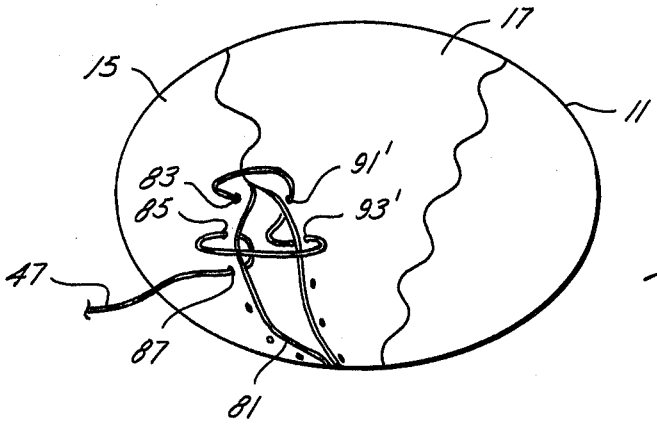

The gap is then closed by stitching thread 47 through the unstitched seam holes of the gap. Because one of the desired characteristics of the footbag is uniformity of reaction when kicked, this final stitching procedure should result in a seam as nearly equivalent as possible to the seam resulting from the initial stitching procedure. Because the seam already sewn becomes an inside seam when the cover is tucked inside out through the gap, the final stitching procedure should also yield an inside seam. Such a final stitching procedure is shown in FIG. 7. Without aligning the corresponding seam holes, thread 47 is stitched through seam hole 91, which is the next unstitched seam hole in segment 17, from the smooth side to the rough side. Thread 47 is then stitched through seam hole 93, which is the unstitched seam hole in segment 17 adjacent seam hole 91, from the rough side to the smooth side. The same procedure as was followed in stitching through seam holes 91, 93' is followed for seam holes 85, 87, which are the next unsewen seam holes in segment 15.

This procedure is continued until thread 47 has been stitched through the last remaining seam hole. The thread should not be pulled tight as the thread is stitched through the seam hole of gap 81. Otherwise, the last seam holes will be too difficult to stitch.

If, as in the preferred embodiment, the segments are identical and have an even number of seam holes, the last seam hole stitched will be in the same segment as that through which thread 47 was first stitched; i.e., as shown in FIG. 3, the last seam hole stitched will be seam hole 95'. If, on the other hand, the segments each have an odd number of seam holes, the last seam hole stitched will be in the other segment; i.e., seam hole 89 as shown in FIG. 3. In either case, thread 47 will extend from the smooth side to the rough side of the last-stitched seam hole. Thread 47 should then be restitched through the seam hole adjacent the last-stitched seam hole from the rough side to the smooth side.

Thread 47 is then pulled tight gradually, working from seam hole 83 toward the seam hole through which the free end of thread 47 extends. As thread 47 is pulled tight, the peripheries should be tucked inwardly. This procedure causes the smooth sides of the corresponding seam holes to align with one another as gap 81 is closed. Furthermore, the resulting seam will be an inside seam identical to that produced during the initial stitching procedure.

When gap 81 is fully closed and seam 49 is uniform along its entire length, thread 47 is tied into knot 51. Knot 51 should be made as small as possible and as close as possible to cover 11. The unknotted free end of thread 47 is burned away almost to knot 51. Knot 51 is melted in order to keep it from becoming untied. Knot 51 is then tucked into seam 49 as much as possible.

The method of assembly described involves hand stitching. Handstitching is preferred over machine stitching because it does not tend to unnecessarily gather the cover material as much as machine stitching does. Furthermore, the finished seam is more uniform since the last few stitches, i.e. those made to close the gap, must be done by hand and can be better matched to hand stitching. Also, most machines use double thread stitching which results in a stiffer, less desirable seam. Thus, hand stitching results in a better embodiment of the footbag.

(d) Use

The footbag may be used in games involving any number of persons. The games may involve a single person, several individual persons, or anywhere from one to four persons making a team.

Figure 8:
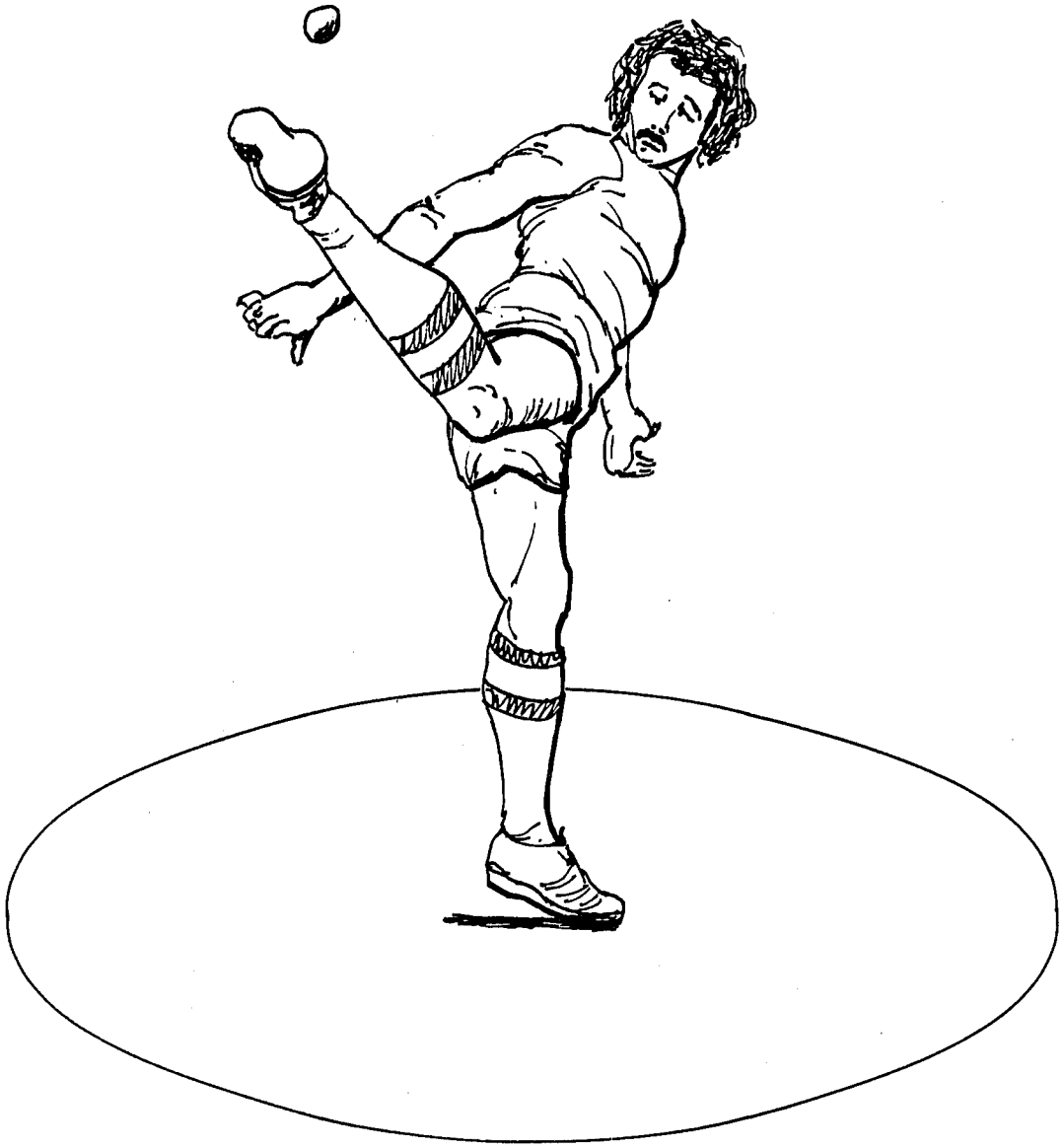
FIG. 8 is pictorial view of the embodiment of the invention in use.

In playing a game involving a single individual, the main objective is to keep the footbag airborne as long as possible using the feet and knees while performing five basic kicks; the toe kick, back kick (using the heel of the foot) knee kick, outside kick (see FIG. 8), and inside kick (using the instep). In playing the game a person is able to use either foot depending upon where the sack is in respect to his body. For example, if the sack is approaching a player's left side, he should attempt to use his left foot and if approaching his right side, he should use his right foot.

The individual game is to be played on a flat surface having a painted circle with a diameter of approximately 10 feet. The player is to kick the footbag using the five basic kicks. The player attempts to keep the footbag airborne for as long as possible while maintaining his position within the painted circle.

In playing with teams the game is played on a rectangular court having a width of X feet and a length of Y feet. The court is divided by a net having a height of Z inches. The objective is for the team members to return the footbag over the net upon three contacts and the first person on the first team to miss either loses his serve or obtains a point. The team obtains a point it if succeeds during its service. If the other team was serving and failed to keep the footbag airborne, then no point is scored but merely the service goes to the other team.

The objective of these games is the development of the intensity of one's concentration and the development of his physical capabilities. The game assists in developing superior eye-to-foot coordination and enhances balance and quickness. Further, a person can prove his physical dexterity and flexibility along with enjoyment through self competition.

Although the footbag, the method of assembling a footbag, and the games for using a footbag described in detail hereinabove have been found to be most satisfactory and preferred, many variations in the footbag and the method of assembly are possible. Because many varying and different embodiments may be made within the scope of the inventive concept herein taught, it should be understood that the details herein are to be interpreted as illustrative and not in a limiting sense.

I claim:

1. A game footbag comprising a pair of web-like, matching, generally figure-eight-shaped cover portions each formed of an abrasion-resistent, unitary, leather-like pliable material, securing means defining a continuous seam stitching together the peripheries of said cover portions, with margins thereof drawn together and disposed in face-to-face abutting relationship along and projecting toward one side of said seam, said joined cover portions forming a pliantly changeable-configuration, generally spherical chamber having a diameter no greater than three inches with said projecting margins extending into said chamber, and fluid, particulate, pellets of polyethylene filler material disposed within said chamber.

2. The footbag of claim 1, on the outside of which said seam defines a pliantly deformable joint establishing subtantially exact curvilinear flushness between contiguous outside expanses of said cover portions.

3. The footbag of claim 1, wherein said securing means comprises an elongated filament-like element stitched to said peripheries.

4. The footbag of claim 1, wherein said filler material is substantially non-resilient.

5. The footbag of claim 4, wherein the particles of said filler material have non-angular, curvilinear outside surfaces.

* * * * *